US007850843B2

(12) United States Patent
Zare

(10) Patent No.: US 7,850,843 B2
(45) **Date of Patent: *Dec. 14, 2010**

(54) SEPARATION OF COMPLEX MIXTURES BY SHEARING

(75) Inventor: Richard N. Zare, Stanford, CA (US)

(73) Assignee: Petroshear Corporation, Los Angelos, CA (US)

( * ) Notice: Subject to any disclaimer, the term of this patent is extended or adjusted under 35 U.S.C. 154(b) by 1217 days.

This patent is subject to a terminal disclaimer.

(21) Appl. No.: 11/231,709

(22) Filed: Sep. 20, 2005

(65) Prior Publication Data

US 2006/0076268 A1 Apr. 13, 2006

Related U.S. Application Data

(63) Continuation-in-part of application No. 11/129,144, filed on May 13, 2005.

(60) Provisional application No. 60/611,918, filed on Sep. 21, 2004.

(51) Int. Cl.
*C10L 1/00* (2006.01)
*C10M 101/00* (2006.01)

(52) U.S. Cl. ..... 208/370; 208/14; 508/110; 44/300

(58) Field of Classification Search ..... 208/370, 208/14, 308; 508/110; 44/300
See application file for complete search history.

(56) References Cited

U.S. PATENT DOCUMENTS

| | | | | |
|---|---|---|---|---|
| 4,265,731 | A | 5/1981 | Mitchell | 208/80 |
| 4,626,237 | A * | 12/1986 | Galloway, Jr. | 494/37 |
| 4,992,210 | A | 2/1991 | Naeger et al. | 252/389.62 |
| 5,209,765 | A * | 5/1993 | Kolpak et al. | 96/157 |
| 5,320,500 | A * | 6/1994 | Cholet | 417/375 |
| 5,746,908 | A | 5/1998 | Mitchell | 208/251 |
| 6,165,349 | A * | 12/2000 | Madar | 208/55 |
| 6,391,190 | B1 * | 5/2002 | Spence et al. | 208/390 |
| 6,572,123 | B2 | 6/2003 | Calmeise et al. | 280/47.35 |
| 6,656,366 | B1 * | 12/2003 | Fung et al. | 210/737 |

OTHER PUBLICATIONS

Macosko, Christopher W. "Rheology: Principles, Measurements, and Applications" (1994) VCH Publishers, Inc.

* cited by examiner

*Primary Examiner*—Ellen M McAvoy
(74) *Attorney, Agent, or Firm*—Lumen Patent Firm

(57) ABSTRACT

A more energy-efficient method of processing crude oil is achieved by viscoelastic shearing in order to increase the vapor pressure of the crude oil. This change in vapor pressure allows a more efficient separation of volatile components from non-volatile components in the crude oil. By optimizing the energy expenditure for shearing and the energy expenditure for separating the volatile components from the non-volatile components of the crude oil, while simultaneously removing the volatile components by distillation, one can reduce the overall energy input for the separation. Alternatively, it is possible to affect the distillation at a reduced temperature.

12 Claims, 3 Drawing Sheets

SEPARATION OF COMPLEX MIXTURES BY SHEARING

CROSS-REFERENCE TO RELATED APPLICATIONS

This application claims priority from U.S. provisional Patent Application No. 60/611,918, filed Sep. 21, 2004, which is incorporated herein by reference. This application is a continuation in part of U.S. patent application Ser. No. 11/129,144, filed May 13, 2005, which is incorporated herein by reference.

FIELD OF THE INVENTION

The present invention relates generally to petroleum processing. More particularly, the present invention relates to decreasing the energy input or temperature required for separation of crude oil mixtures into components.

BACKGROUND

For many industrial processes it is necessary to perform distillations to separate components of a mixture. For most commercial distillations the volumes are very large, so that energy efficiencies can have significant economic impact. Finding ways to improve energy utilization is thus of great commercial interest. Another important consideration for distillation is the temperature required to separate different components. At high temperatures, the mixture may undergo unwanted reactions that limit the recovery of components. Thus, there is substantial interest in reducing the energy input and/or temperature required to separate these components.

The separation of crude oil is a major industrial process. The extraordinarily large volumes that are handled make minor improvements in efficiency and recovery of extreme economic importance. Petroleum in its unrefined state is referred to as crude oil. Commercially useful products are obtained by separation or fractionation of the crude oil by distillation into various hydrocarbon components or fractions, which fractions may be subjected to further treatment to enhance the value of the fractions. The fractions may be characterized by the average number of carbon atoms of the molecules in a fraction, the density of the fraction and the boiling range of the fraction. For classification purposes, the fractions may be designated as follows: (a) straight run gasolines, boiling up to about 390° F.; (b) middle distillates, including kerosene, heating oils, and diesel fuel, boiling in the range of about 340 to 650° F.; (c) wide cut gas oils, including waxes, lubricating oils and feed stock for catalytic cracking to gasoline boiling in the range of about 650 to 1000° F.; and (d) residual oils, including asphalts, boiling above about 1000° F.

In processing petroleum, crude oil is first desalted and dehydrated, as necessary, and may be passed through heaters where the temperature is raised. The crude oil may be raised to an elevated temperature, so that under the conditions of the process substantially all of the gasolines and middle distillates are in the vapor phase. The crude oil liquid and vapor mixture is then piped to a distillation or fractionating tower for "topping," which represents the first step in separating the crude oil into its constituent fractions.

Up to the point of fractionation, the entire crude oil may have been heated and maintained at an elevated temperature to maintain the light fractions in the vapor phase, while maintaining the heavy fractions at a temperature that allows for a sufficiently lowered viscosity to permit the flow of the heavy fraction. There is much inefficiency in this procedure in requiring heat to allow for the separation of the light fractions from the heavy fractions and heating the entire mixture to permit this separation. In addition, the high heat required for this separation may reduce recovery of certain components due to unwanted reactions.

Shear induced phase separation ("SIPS") has been studied in a number of systems, particularly with polymeric solutions comprising two or more components. In these studies it is found that under certain conditions of shear there is a demixing of components resulting in phases enriched for the components. By observing the composition under shear, one frequently encounters turbidity and changes in such properties as birefringence and light scattering.

To better understand the effect of shear on vapor pressure, it is necessary to appreciate that the vapor pressure of a liquid is a delicate balance between the rate of molecules escaping the surface of the liquid and the rate of molecules sticking to the surface of the liquid that strike it from the gas phase. The effect of shearing is to change the energy content of molecules at the gas-liquid interface as well as change the spatial configuration of molecules on the surface of the liquid. In some cases, it also changes the shapes of the molecules, such as inducing a transition from coiled to uncoiled. In particular, shearing can promote demixing in which the attraction between unlike molecules in a mixture is reduced. The result is for shearing to change the vapor pressure of the system by altering the rate balance described above.

When a solid or liquid is subject to a shear, a nearly instantaneous deformation occurs as if it were like a spring (Hooke's law) but this rapid deformation is often followed by a continuous one (a creep). This time-dependent response to shear is called viscoelasticity. Viscoelastic liquids can be described by different time scales for how they relax after a stress has been applied or removed.

To understand SIPS better it is necessary to appreciate the effect of viscoelasticity on phase separation. A liquid composed of two types of molecules A and B that are dissolved (mixed) can be separated (become demixed) into phases A and B under certain circumstances by the application of stress to the liquid mixture. The dynamics of the phase separation depend on the temperature, the relative concentrations of A and B, the viscoelastic properties of the mixed and demixed liquids, and the surface tension between the two phases. What is important for an understanding of this invention is that for a fixed temperature and for a fixed relative concentration, shearing can affect the solubility of A and B through their viscoelastic properties. Specifically, shearing can promote mixing or cause demixing depending on the shear rate. It is known from previous studies of polymer blends that SIPS is a common effect. Moreover, the shear induced phase separation often is sustained only by continuous shearing so that when shearing is removed or reduced, the liquid system will relax to a mixed state as a function of time unless other actions are taken, such as changing the temperature, or the relative composition of A and B, or by adding some stabilizing agent. It should be noted that the phenomenon of SIPS may occur in solutions of more than two types of molecules as well, with the complex solutions comprising crude oils being an example.

Generally, SIPS has been viewed as a neutral or even detrimental effect in industrial processes, because such processes ordinarily specify or assume the use of relatively homogeneous, well-mixed substances. It has not been understood that such separation could be intentionally affected and exploited for more efficient processing. In addition, it has not been appreciated that shearing could be used to reduce the temperature required for processing.

There is a great deal of interest in improving the processing methods used for crude oil. Because of the huge amounts of crude oil that are processed, very small improvements can have large economic consequences. It is therefore of interest to provide treatments of the crude oil and like mixtures that reduce the energy input for separating the light and heavy fractions, decrease the temperature required to separate light and heavy fractions, improve the separation into different components, increase the speed of the separation process or all of these. The subject invention addresses this issue using SIPS.

SUMMARY OF THE INVENTION

Complex liquid mixtures comprising divergent components as exemplified by crude oil are economically processed by conditioning the crude oil at an elevated temperature using viscoelastic shear. The shear conditions are employed to enhance the vapor pressure of lower boiling fractions to reduce the heat input necessary to vaporize such lower boiling fractions and to avoid raising the mixture to unwanted higher temperatures. In addition, depending on the purpose for the process the shear conditions can be selected to provide an enriched light phase that may be subject to distillation and fractionation into its components and an enriched heavy phase that may be processed to provide additional useful components, where less energy is employed for the separation than conventional methods. Alternatively, the crude oil may be sheared and distilled simultaneously.

By shearing it is meant one part of the complex fluid moves at a different rate than another part. Various shearing devices can be employed. These devices are conveniently divided into two groups. In the first group are drag flow devices in which the shear is generated between two surfaces in contact with the complex fluid so that the two surfaces move at different rates with respect to one another. In the second group are pressure-driven flow devices in which the shear is generated by a pressure difference over the channel through which the complex fluid flows. In one useful embodiment we describe a drag flow device in which one surface is stationary while the other is mobile. In another embodiment, the shearing device also serves as a distillation column. It should be understood that other embodiments are possible and that numerous ways exist to apply stress to crude oil.

BRIEF DESCRIPTION OF THE FIGURES

The present invention together with its objectives and advantages will be understood by reading the following description in conjunction with the drawings, in which.

DETAILED DESCRIPTION OF THE INVENTION

Figure 1:
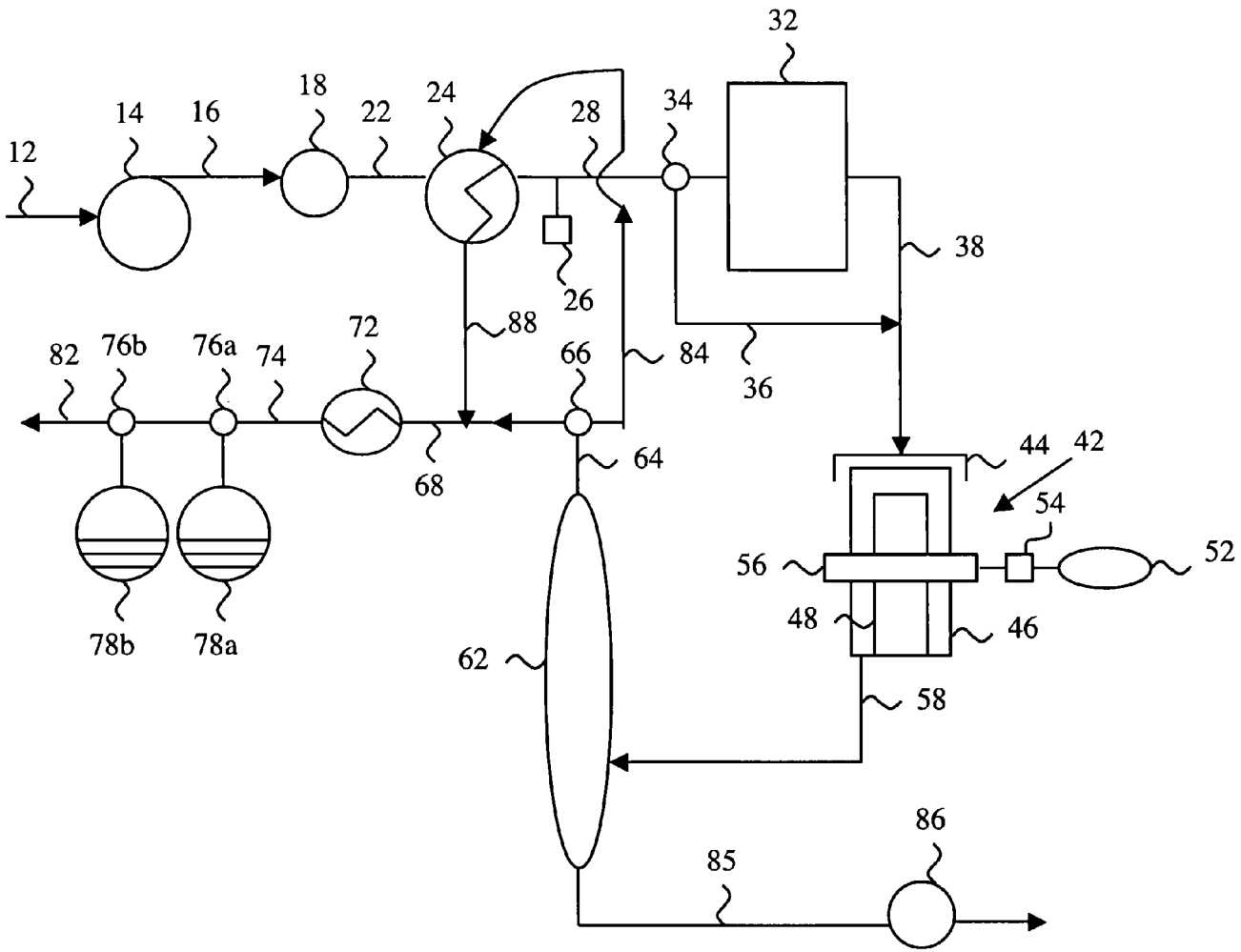
FIG. 1 is a flow diagram of a process according to this invention.

Improvements in distillation separations are obtained by shearing a medium either prior to or while subjecting the medium to vaporization and distillation. The mixture is subjected to sufficient shear to change the state of the mixture so that it approaches more closely Raoult's law conditions. Namely, the vapor pressures of the mixture would approach the formula for a two component mixture $$P_{Total}=P_1x_1+P_2x_2$$

where $P_1$ and $P_2$ are the vapor pressures of the two liquids constituting the binary mixture, and $x_1$ and $x_2$ are their molar fractions. One can readily determine the required shearing to substantially optimize the increase in vapor pressure of the volatile fractions present in the mixture by empirically increasing the shear and measuring the total vapor pressure. By relating the total vapor pressure to the energy required to provide the shearing forces, one can calculate the energy requirements for producing the shear and distilling the volatile components. In this way, one can optimize the energy utilization of the system. In some cases, if desired, shearing may result in a demixing or phase separation between a first volatile fraction and a second relatively non-volatile fraction.

In a first aspect of the subject invention, an improved method is provided for reducing the overall energetic input or temperature required for distilling the volatile fraction components of a complex liquid mixture or components having substantially different physical characteristics. The method finds particular application with crude oil and allows for conditioning of the mixture. After preliminary treatment of the mixture, as appropriate, the mixture is introduced into a shearing device and viscoelastically sheared at a sufficient rate to increase the vapor pressure of the mixture to more closely approximate Raoult's law. By optimizing the energy expenditure for the shearing and the energy expenditure for separating the volatile components from the non-volatile components, while simultaneously removing the volatile components by distillation, one can reduce the overall energy input for the separation. In addition, because shearing results in an increase in vapor pressure at any given temperature that is unrelated to any increase in temperature resulting from the shearing, a lower temperature is required to separate volatile components from the mixture.

In a second aspect of the subject invention, an improved method is provided to efficiently separate complex liquid mixtures of components having substantially different physical characteristics. The method simplifies the formation of at least two fractions of differing characteristics, which may then be readily separated by conventional methods of separation. The method finds particular application with crude oil. In one embodiment, the method allows for conditioning of the crude oil mixture. In this embodiment, after preliminary treatment of the mixture, as appropriate, the mixture is introduced into a shearing device and viscoelastically sheared at a rate that provides for separation of the mixture into at least two phases. One phase of the conditioned mixture, which may be described as a light phase or fraction, can then be separated by distillation or other fractionation means. The other phase, which may be described as a heavy phase or fraction, can be subjected to further processing, e.g., shear treatment, or further conventional processing. In an alternative embodiment, the method allows for separation of the crude oil mixture into at least two fractions. In this method, after preliminary treatment of the mixture, as appropriate, the mixture is introduced into a combined fractionation/shearing device, sheared at a rate that provides for separation of the mixture into at least two phases, and simultaneously separated into at least two fractions. The combined fractionation/shearing device may be a distillation/shearing device.

Crude oil can be used as paradigmatic as being a viscoelastic liquid with a range of components of varying characteristics; there is the light fraction which finds use as a feed for the production of chemicals, a light blending stock for gasoline, etc., and a gasoline fraction referred to as straight run or virgin gasoline; an intermediate fraction, which can be divided into a kerosene fraction utilizable as a furnace oil, jet fuel, etc., and a virgin or straight run gas oil, which may be used as a source of lubricating oil and/or waxes or as cracking stock for the production of gasoline; and the heavy fraction or bottoms cut, which may be processed to produce asphalt, lubricating oils, wax products, etc. By conditioning the crude oil using appropriate conditions of temperature and shear, roughly two or more phases are produced, where one phase is enriched for the light fraction and a second phase is enriched for the heavy fraction.

Various methods and apparatus may be used to condition the crude oil. Numerous devices have been designed to provide shear to a fluid, particularly in relation to the treatment of polymer mixtures and for rheology. These systems often employ a moving or mobile surface that moves in relation to an immobile surface with the medium between the two surfaces. These devices have employed concentric cylinders, where the outer cylinder is usually the rotating cylinder, cones and platforms, where the cone is the rotating element, an endless belt and an immobile platform, a moving platform and an immobile platform, and the like. The devices rely on the introduction of fluid between the two surfaces and the resulting shear from the flow of the fluid between the two surfaces. The devices may have as their primary elements, optionally a heating element to reduce the viscosity of the crude oil to a flowable mixture, a pump or impeller to introduce the flowable crude oil to a shearing device to provide a conditioned mixture, a distillation column for separating the conditioned mixture into multiple fractions, and a receptacle for receiving the conditioned mixture, where the low boiling fraction may be removed, and as appropriate fractionated, using heat, steam, a combination of heat and vacuum, or the like.

For the situation where demixing occurs with separation into fractions or phases, without being held to the theory as the correct basis of the observed results, the following is believed to be the basis for the use of shear induced phase separation ("SIPS") for improving crude oil processing. At any given temperature, for a particular substance, there is a pressure at which the vapor of that substance is in equilibrium with its liquid or solid forms. This is termed the vapor pressure of that substance at that temperature. When the ambient pressure equals the vapor pressure of any liquid, the liquid and vapor are in equilibrium. Below that temperature, vapor will condense to liquid. Above that temperature, liquid will turn to vapor. At any given pressure, the boiling point of a substance is the temperature at which the vapor pressure of the substance in liquid form equals the ambient pressure.

Raoult's law has been described previously for a binary mixture. The generalization to more complex mixtures containing n different components is straightforward:

$$P_{Total} = \sum_{i=1}^{n} x_i P_i$$

For a binary mixture, this law is strictly valid only under the assumption that the bonding between the two liquids is equal to the bonding within the liquids. Therefore, comparing actual measured vapor pressures to values that are predicted from Raoult's law allows information about the relative strengths of bonding between liquids to be obtained.

If the measured value of vapor pressure is less than the predicted value, fewer molecules have left the solution than expected, which is attributed to the strength of bonding between the liquids being greater than the bonding within the individual liquids. As a consequence, fewer molecules have enough energy to leave the solution. Conversely, if the vapor pressure is greater than the predicted value more molecules have left the solution than expected, caused by the bonding between the liquids being weaker than the bonding within each. Again the generalization to multi-component mixtures is straightforward.

Crude oil is a system that could exhibit extreme deviations from Raoult's law. In this instance in complex liquids mechanical deformation of the liquid through compression, extension and shear may cause a temporary or even permanent separation (demixing) of the components, which therefore affects the vapor pressure of the mixture. These deformations may result in a system out of equilibrium and during that nonequilibrium condition it should be possible to distill the components with less supply of heat, that is, at a lower temperature, than when the system is at equilibrium. In other words, separation by distillation will be favorable for systems that (1) do not obey Raoult's law in the sense that two or more components bind together more tightly than with each pure substance and (2) can be separated (demixed) by mechanical agitation that induces stress, that is, compression, extension and shear, in the liquid.

Crude oil is a complex mixture, primarily of hydrocarbons, ranging from a range of alkanes that boil below about 100° C. to heavy residual that has to be cracked in order to be distilled or is used as a tar or asphalt. The density of the crude oil is generally in the range of about 10->40° API. The viscosity of crude oil depends upon its source and temperature, generally ranging from about 1 to 100 centiStokes (cST) for light crude to 100 to 10,000 cSt for heavy crude at original reservoir conditions of 150-300° F. Kinematic viscosity is measured using ASTM D445. Depending upon the viscosity of the crude oil feedstock, the temperature of the crude oil introduced into the SIPS device will generally be at least sufficient to allow for flow of the crude oil, usually at least about 125° F., usually in the range of about 125 to 400° F., where the temperature may increase with the shearing of the crude oil. Based on the temperature and the crude oil source, there will usually be a gas phase that may be separated prior to the shearing or may be retained in the SIPS device under a mildly elevated pressure to keep most of the gas phase dissolved in the crude oil mixture.

The crude oil may have been subject to prior processing, such as desalting (U.S. Pat. Nos. 4,992,210, 5,746,908 and references cited therein) and dehydration (U.S. Pat. No. 6,572,123, and references cited therein). These processes are conventional and they will not be described here. While in many instances, in order to reduce the viscosity of the crude oil fraction, a light fraction is mixed with the crude oil, that expedient will normally not be used in the subject process as reducing the efficiency of the process. The crude oil may also have been processed through prior distillation, so that the feedstock to the SIPS device has previously had some of the light fractions removed.

The stream will generally have a velocity in the range of about 1 to 30 barrels per minute, where the velocity will depend upon the capacity of the SIPS device, the amount of shearing to be applied, the nature of the feedstock, and the temperatures of stream input and output or other parameter that may affect the efficiency of the demixing of the feedstock. Also, the spacing or gap between the immobile and mobile surfaces will vary with the nature of the device as well as the other parameters, generally being in the range of about 0.5 to 2.0 mm. The time for the shearing will generally be in the range of about 10 to 100 milliseconds per pass through the SIPS device, and depending on design some portion of the fluid may pass again through the same or a different SIPS device. The time may be controlled by the feed rate. Rotation rates will depend upon the design of the shearing mechanism and will generally be in the range of about 6,000 to 25,000 rad/s. If oscillatory vibration is employed in the shearing unit, oscillation frequencies may vary in the range of about $10^{-5}$ to 500 rad/s with an amplitude of angular motion in the range of about 50 μrad to 0.5 rad. If desired, an oscillating vibration may be imparted to the feedstock during the shearing. With any one apparatus, the shearing force required for separation as a function of temperature may be determined empirically for each crude oil feed stock and optimized for energy input and economics of separation. The shear applied to crude oils will generally be in the range of 10,000 to 100,000 $sec^{-1}$ (units which may for clarity also be expressed as, e.g., millimeters per millimeter per second, to convey the proximity of different fluid velocities under shear.) For an analysis of the conditions for shear separation of a mixture, see "RHEOLOGY: Principles, Measurements, and Applications," Christopher W. Macosko, 1994, VCH Publishers, Inc.

Under the first aspect of the subject invention, conditioning and distillation are concurrent processes, so that the volatile components are removed from the mixture during the shearing. In this aspect, heat will be continuously introduced to replace the heat of vaporization of the volatile components to maintain the distillation.

In the second aspect of the invention, after being processed in the shearing device, the conditioned feedstock may then be treated in a number of ways. For example, the conditioned feedstock may: directly enter a distillation column; flow through an outlet and be transported to another site for further processing; be stored while maintaining an elevated temperature that still retains the flow properties of the conditioned crude or cooled to a lower temperature that prolongs the shear induced phase separation; have the light fraction allowed to flash off or be subject to fractionation; or the conditioned feedstock distilled to obtain the crude oil components that are volatile under the conditions of the distillation. Alternatively, the feedstock may be separated and sheared simultaneously, using a combined distillation/shearing device. The distillation may employ a vacuum or steam for the separation as described in U.S. Pat. No. 4,265,731.

Desirably, after shearing, the conditioned medium will be cooled to a temperature that will preserve the separation, usually as low a temperature as will allow for flow, generally reducing the temperature in the range of about 5 to 100° F., depending upon the temperature of the conditioned crude oil after it leaves the shearing device.

A system can be employed with the subject methodology that allows for automated processing of crude oil. One can employ a central data processor and sensors to measure temperatures, pressures, shear rate, characteristics of the crude oil before and after shearing, vapor pressures of fractions, and the like. The information from the sensors is sent to the central data processor for analysis and control of the various stages of the processing. The crude oil is characterized by any one of the following parameters: its source, composition, viscosity, specific gravity, optical rheometry, light fraction content, heavy fraction content, water content, salt content or other parameter of interest for the processing of the crude oil. By measuring the viscosity and/or flow rate of the feedstock, the temperature, pressure and/or rate of pumping of the feedstock are controlled to provide the desired viscosity and flow characteristics. The feedstock is then fed into the shearing device where the properties of the feedstock in the shearing device or exiting the shearing device are monitored and the flow rate and shearing force are controlled to provide a conditioned feedstock having the appropriate characteristics. The conditioned feedstock may then be moved to a distillation column where the conditioned feedstock is fractionated into appropriate fractions for use or further processing. Alternatively, the feedstock may be sheared and separated simultaneously using a combined distillation/shearing device. The products of the fractionation may then be stored and/or further fractionated and/or processed, such as cracking, hydrofining, hydrogenation, etc. In general, the temperature of the feedstock entering the shearing apparatus should be maintained as low as possible consistent with the need for flow at a practical rate because for the same composition it requires more shear to cause demixing as the temperature increases.

One may also monitor the total energy input for obtaining the light fractions as a distillate. By monitoring the energy employed for shearing the mixture and the heat supplied for maintaining the distillation, one can determine the optimum conditions for to minimize the energy input for the separation. The mechanical and thermal energies involved may be readily measured, or example with a motor one can measure the electrical energy employed for the shearing and for the heating one can determine the calories employed based on the fuel used.

The heavy fraction phase may be subjected to further processing by mechanically stressing in a shearing device. Particularly, the heavy residuum may be conditioned, once the heavy fraction phase has been passed through an atmospheric tower, but before entering a vacuum tower.

In FIG. 1 a diagrammatic view of the subject process is provided. In the process, crude oil or other feedstock is fed into line 12 driven by pump 14 through line 16, where the pressure in the line is controlled by pressure gauge 18. The feedstock is moved through line 22 into heat exchanger 24 where the feedstock is heated to the desired temperature. The temperature in the heat exchanger is controlled by temperature regulator 26. The heated feedstock is then transported through line 28 to processing unit 32, where the crude oil may be processed, such as for desalting or dehydration. Alternatively, valve 34 may divert the feedstock through alternative line 36 directly to line 38, which is the outlet line for processing unit 32. The feedstock is fed by means of line 38 into shearing unit 42. Shearing unit 42 is shown having cap 44, outer rotating and shearing wall 46 and inner immobile wall 48. Motor 52 drives gear box 54 that turns collar 56 to drive outer rotating and shearing wall 46. The feedstock moves between outer rotating and shearing wall 46 and inner immobile wall 48 and is sheared and conditioned by the shearing effect of the movement of the feedstock past the rotating and shearing wall 46. The shearing unit may have various control mechanisms (not shown) to control the degree of shearing and measure the change in properties of the feedstock as it passes through shearing unit 42 and into outlet line 58. Outlet line 58 feeds the sheared and conditioned feedstock to distillation column 62, and the light fraction of the distilled, conditioned feedstock (distillate) exits through line 64. Alternately, the sheared and conditioned feedstock may be fed to another heat exchanger (not shown) where the feedstock is further heated to the desired temperature prior to introduction into distillation column 62.

Valve 66 serves to split the distillate between line 68 and line 84. Line 68 passes through condenser 72 and through line 74, where by means of valves **76*a* and 76*b* the distillate may be directed to a plurality of receptacles or holding tanks 78*a*** and 78*b*. Any waste or pressure release may be vented through line 82. The heavy fraction at the bottom of the distillation column may be transferred from the distillation column 62 by means of line 85 and pump 86 for further processing, as appropriate, including without limitation return to line 12 to be processed again.

By passing all or a portion of the distillate by means of valve 66 to line 84, the distillate may be passed through heat exchanger 24 or other heat exchanger (not shown), or both, to heat the incoming feedstock from line 22. The heat from the condensation of the heavy fraction is used to heat 24. The distillate from heat exchanger 24 is fed through line 88 into line 68 for transfer to a receptacle. The distillate may then be further processed in accordance with the needs for the crude oil products.

Figure 2:
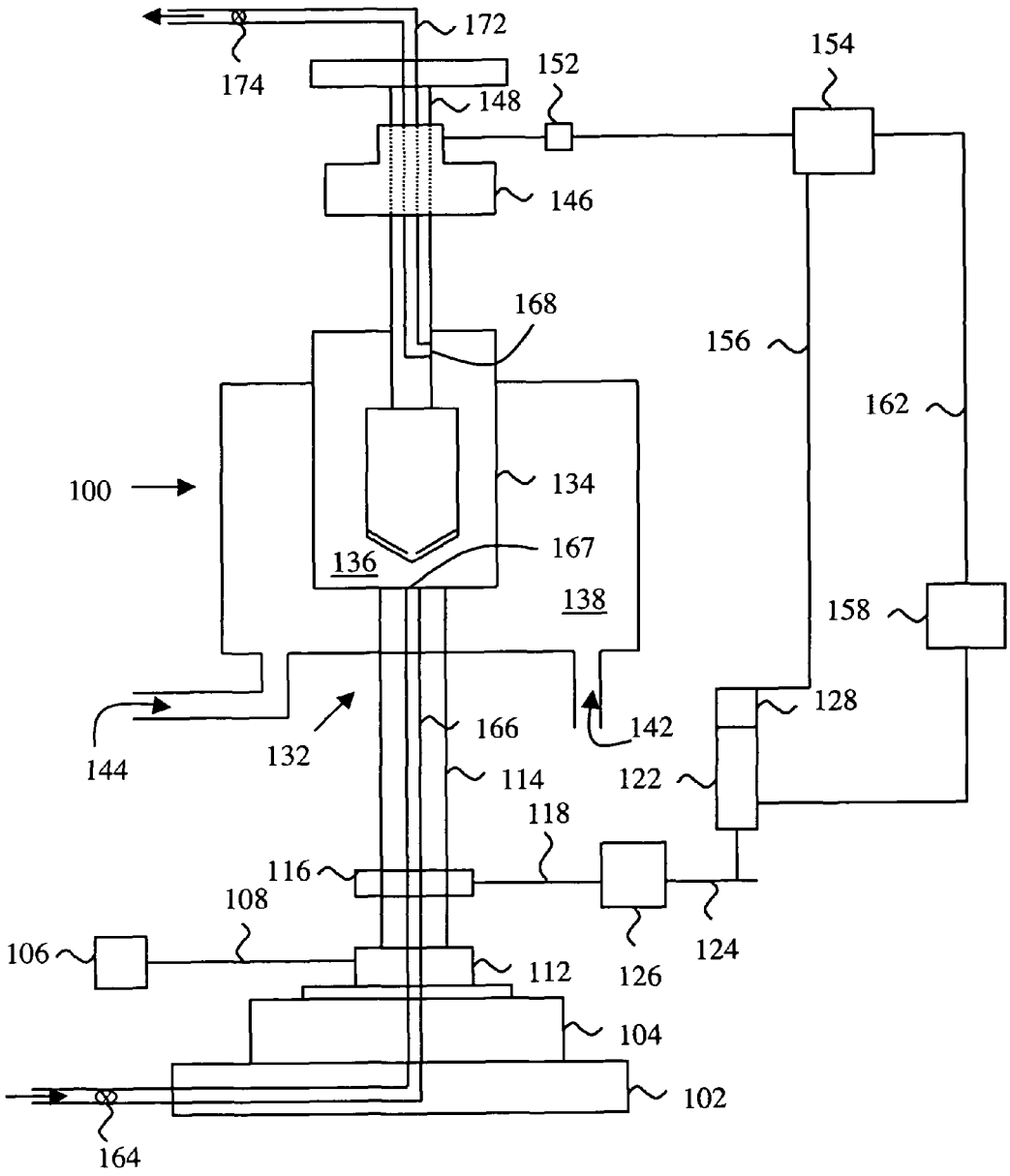
FIG. 2 is an elevational cross-section of a shearing device according to this invention.

FIG. 2 diagrammatically depicts a cross-sectional elevational view of a shearing unit. Shearing unit 100 sits on base 102 supporting electromagnetic clutch 104. An eccentric arm 106 is joined through rod 108 to collar 112. By activating electromagnetic clutch 104, a rotating shaft 114 can be oscillated sinusoidally. The rotating shaft 114 fits in wheel 116 on which is mounted drive belt 118. Drive belt 118 is driven by a motor train including dc motor 122, second drive belt 124 and gear box 126. Tachometer 128 monitors the speed of dc motor 122 and measures angular velocity. Shearing component 132 includes cylinder 134 mounted on rotating shaft 114. Shearing cell 136 is surrounded by a temperature control bath 138 with fluid inlet 142 and fluid outlet 144. An air bearing 146 centers torsion bar 148, whose rotation is sensed by linear variable differential transformer ("LVDT") 152. The LVDT 152 and tachometer 128 send signals to data processor 154. The tachometer 128 sends its signals to the data processor 154 through connecting line 156 and the data processor 154 sends control signals to controller 158 through connecting line 162. The dc motor 122 can be varied in conjunction with changes in torque sensed by LVDT 152. The feedstock is introduced into the shearing component through valve 164 and line 166, which goes through base 102 and through the center of rotor 114 and enters the shearing cell 136 through outlet 167. The feedstock is sheared in shearing cell 136, rises to the top of shearing cell 136 and is then transported through outlet 168 through line 172, which passes concentrically through torsion bar 148. Flow out of shearing cell 136 is controlled by outlet valve 174.

While the device shown in FIG. 2 can be used for continuous shearing of a feedstock, it may also be used for defining the parameters to be used in the shearing of the feedstock. By using such a device, where the feedstock is introduced into shearing cell 136 in a batch, the processing parameters for the shearing can be determined or the feedstock can be processed batchwise.

Figure 3:
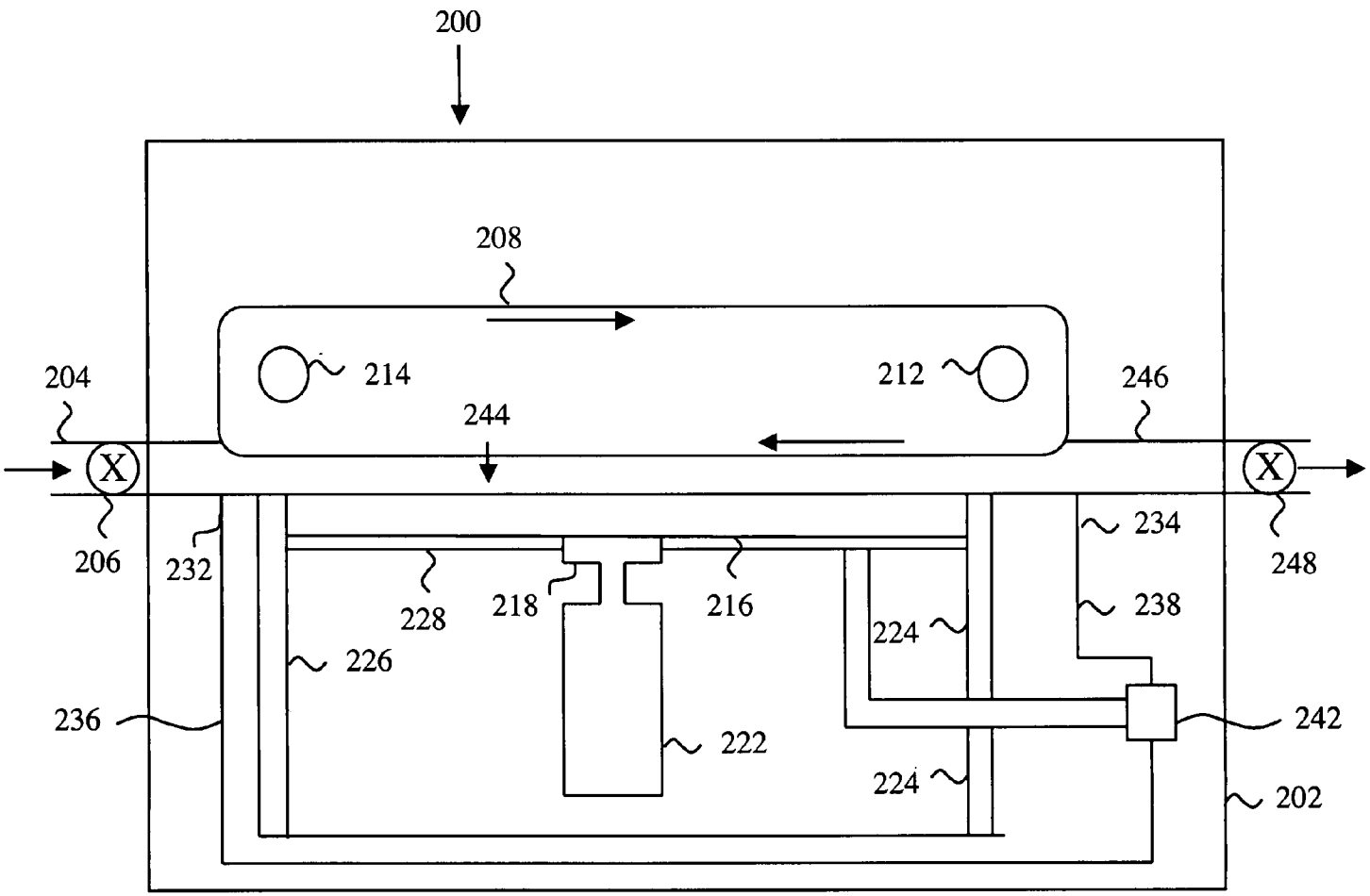
FIG. 3 is an elevational cross-section of an alternative shearing device according to this invention.

In FIG. 3 an alternative device is shown where a sliding plate as an endless belt is used to provide the shear. This shearing device is shown as a diagrammatic view in elevational cross-section. Shearing device 200 is housed in housing 202. The feedstock is introduced through conduit 204 with the flow rate controlled by valve 206. An endless belt 208 is employed driven by drive shafts 212 and 214 in a direction counter to the flow of the feedstock. Fixed plate 216 is mounted on platform 218 and can be moved orthogonally to the direction of flow of the feedstock by means of hydraulic piston 222 to change the gap between the fixed plate 216 and the endless belt 208. Guides 224 and 226 orient the movement of the fixed plate 216. Affixed to the fixed plate 216 is a heating element 228 to maintain the temperature during shearing. Temperature gauges 232 and 234 monitor inlet and outlet temperatures, respectively, of the feedstock and are connected through wires 236 and 238, respectively, to temperature controller 242. By monitoring the inlet and outlet temperature, the temperature in shearing zone 244 can be maintained. The feedstock is fed into the shearing zone 244 through line 204 and is sheared by the endless belt 208 as the feedstock is driven under pressure through the shearing zone. The conditioned feedstock exits into conduit 246 and passes through control valve 248 and may then be subject to further processing.

Instead of a drag flow device a pressure device may be employed which provides pressure to drive the crude oil through an orifice or other similar structure that allows for shearing as the crude oil moves past the surface of the shearing component. Thus, the pressure differential between the crude oil entering the shearing component and exiting the shearing component provides the driving force for the mechanical stress and conditioning.

The subject invention provides for more efficient processing and utilization of crude oil, as well as other complex mixtures having components of disparate characteristics. A relatively low energy processing of the crude oil using shear induced phase separation, concurrent with or followed by heating and distillation, replaces the much higher energy input of heating and distillation of crude oil that has not undergone shear induced phase separation. In this way, the crude oil can be effectively divided into two fractions, a lower boiling fraction that may be further separated into its components and a higher boiling fraction that may be subject to processing without significant loss of the lower boiling fractions in the subsequent processing.

All references referred to in the text are incorporated herein by reference as if fully set forth herein. The relevant portions associated with this document will be evident to those of skill in the art. Any discrepancies between this application and such reference will be resolved in favor of the view set forth in this application.

Although the invention has been described with reference to the above examples, it will be understood that modifications and variations are encompassed within the spirit and scope of the invention. Accordingly, the invention is limited only by the following claims.

What is claimed is:

1. A method for processing crude oil, comprising:

a. applying shear forces to an oil stock containing volatile components with a shearing device to create different flow rates in said oil stock, wherein said different flow rates are sufficient to create:

i. at least two phases in said oil stock;

ii. at least two fractions in said oil stock;

iii. an increase in the vapor pressure of at least one of said fractions in said oil stock; and b. separating said volatile components from said oil stock.

2. The method as set forth in claim 1, wherein said separating comprises distilling said volatile components during said shearing.

3. The method as set forth in claim 1, further comprising optimizing the energy expenditure for said shearing.

4. The method as set forth in claim 1, further comprising optimizing the energy expenditure for said shearing.

5. The method as set forth in claim 1, further comprising monitoring an energy input or a temperature required for said separating.

6. The method as set forth in claim 1, further comprising heating said crude oil stock during said shearing and said separating.

7. The method a set forth in claim 6, wherein said heating results in a temperature of at least about 125° C.

8. The method as set forth in claim 1, further comprising determining said sufficient rate by empirically increasing said shearing and measuring said vapor pressure.

9. The method as set forth in claim 1, wherein said crude oil comprises very heavy crude oil or bitumen.

10. The method as set forth in claim 1, wherein said shearing is at least 10,000 $sec^{-1}$.

11. The method as set forth in claim 1, wherein said crude oil stock is substantially free of water and salt.

12. The method as set forth in claim 1, wherein said shearing device comprises a first cylinder wall internal and concentric to a second cylinder wall, wherein said first cylinder wall is fixed and said second cylinder wall rotates about said first cylinder wall.

* * * * *